US006317942B1

(12) United States Patent
Hankel et al.

(10) Patent No.: US 6,317,942 B1
(45) **Date of Patent: *Nov. 20, 2001**

(54) CASKET AND METHOD OF MANUFACTURE

(75) Inventors: Bryan M. Hankel, Batesville, IN (US); Dennis C. Laphan; Donald R. Maier, both of Cincinnati, OH (US); William F. Neth, Batesville, IN (US); Hans E. Ritter, Batesville, IN (US); Patrick M. Saaf, Batesville, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/619,821

(22) Filed: Jul. 20, 2000

Related U.S. Application Data

(63) Continuation of application No. 09/035,836, filed on Mar. 6, 1998, now Pat. No. 6,094,789.

(51) Int. Cl.[7] ..... A61G 17/00
(52) U.S. Cl. ..... 27/2; 27/10; 27/14
(58) Field of Search ..... 27/1–7, 10, 14, 27/16, 17, 19; D99/1; 220/682, 677, 665; 217/5, 17

(56) References Cited

U.S. PATENT DOCUMENTS

| | | | |
|---|---|---|---|
| 150,843 | 5/1874 | Earnest | 27/10 |
| D. 343,715 | 1/1994 | DeGrezia et al. | D99/1 |
| D. 400,683 | 11/1998 | Saaf et al. | D99/1 |
| 686,308 | 11/1901 | Kregel | 27/2 |
| 756,297 | 4/1904 | Tabor et al. | 27/2 |
| 766,000 | 7/1904 | Skahen | 27/10 X |
| 800,948 | 10/1905 | Skahen | 27/10 |
| 1,026,434 | 5/1912 | Franke | 27/2 |
| 1,033,410 | 7/1912 | Jones . | |
| 1,212,410 | 1/1917 | Skahen | 27/10 |
| 1,558,558 | 10/1925 | Metcalf | 27/10 X |
| 2,147,798 | 2/1939 | Pilcher . | |
| 3,334,392 | 8/1967 | White . | |
| 3,985,169 | 10/1976 | Chow . | |
| 4,517,713 | 5/1985 | Swallert | 27/4 |
| 4,730,370 | 3/1988 | Elder | 27/4 |
| 5,611,124 | 3/1997 | Biondo et al. | 27/2 |

*Primary Examiner*—B. Dayoan
*Assistant Examiner*—William L. Miller
(74) *Attorney, Agent, or Firm*—Wood, Herron & Evans, L.L.P.

(57) ABSTRACT

A casket comprises a shell including a floor, a pair of side walls and a pair of end walls. A pair of caps are closable upon the shell. At least one of the walls is constructed of at least two panels having adjacent abutting edges forming a joint between the panels. A decorative feature disguises the joint to create the appearance of the two panels being a single panel. Each cap has a crown, a longer dimension and a shorter dimension, and is constructed of a plurality of boards extending parallel to the longer dimension and including a center spine board. The center spine board is fabricated from a single full-length board sawed in two; remaining ones of thee cap crown boards are non-full length boards. The gap between the head and foot end caps when closed in combination with the matching grain of the spine boards creates the appearance of the cap crowns being constructed of full length boards. Also, by utilizing at least one full length board in the cap, current tooling may be used. Methods of manufacturing such a casket are also provided.

2 Claims, 4 Drawing Sheets

CASKET AND METHOD OF MANUFACTURE

This application is a continuation of application Ser. No. 09/035,836, filed Mar. 6, 1998, now U.S. Pat. No. 6,094,789.

FIELD OF THE INVENTION

This invention relates generally to caskets, and more particularly to economically manufactured wood caskets.

BACKGROUND OF THE INVENTION

Caskets have for many years been fabricated of wood. Fine woods, such as those used in the manufacture of fine furniture, are often used, for example, mahogany, cherry, oak and the like. As is to be expected, one of the greatest costs associated with the manufacture of wood caskets is the cost of the wood itself. At least two factors drive this cost.

First, the cost per unit length of these fine woods is relatively expensive. Second, it is desirable, from an aesthetic standpoint, to utilize so-called "full length" boards and panels in the construction of wood caskets, that is boards and panels that are the full length of the portion of the casket to be constructed, for example shell side wall, shell end wall and/or cap, rather than short pieces or "scrap." This is because it is desirable to have a uniform wood grain the entire length of the casket, whether it be for the casket shell side walls and end walls, each of which are normally constructed of a single, unitary full length panel, or for the casket caps, which are fabricated of a plurality of full length boards formed into a convex shape for the crown portion of the cap and then sawed in two to create the separate head end and the foot end caps. The former provides for a continuous wood grain on the casket shell side walls and end walls; and the latter provides for a continuous wood grain for each of the boards forming the crowns of the head end and foot end caps. Utilizing such full length boards and panels results in smaller boards and portions of panels, which are cut from the full length boards and panels, being scrapped, thus increasing manufacturing costs.

It would be desirable from a cost perspective to be able to utilize smaller pieces of wood in the construction of wood caskets, for example to use more than one panel to fabricate a casket shell side wall or end wall, and/or to utilize something other than full length boards to fabricate the casket lids. However, prior attempts have not met with complete success.

For example, if one were to abut a pair of wood panels together to form a casket shell side wall, joint is readily apparent to observers of the casket shell side wall, not only because of the seam created by the abutted edges of the panels, but because of the discontinuous or non-matching wood grains of the two panels, i.e. the wood grain is discontinuous at the seam and is therefore not continuous across the joint from one panel to the other panel. Such is generally unsightly and therefore undesirable.

Second, if one were to utilize non-full length boards from which to fabricate the head and the foot end lids, the grains of each and every corresponding board of the head end cap and foot end cap would be non-matching and would be readily apparent upon viewing the casket with both caps in the closed position.

Yet another drawback to utilizing non-full length boards from which to manufacture the head end and foot end caps is that, by and large, the current tooling in the industry is set up to fabricate these lids from full length boards; if non-full length boards were utilized, new tooling would likely have to be designed, purchased and/or built and then implemented.

SUMMARY OF THE INVENTION

The present invention is directed toward overcoming the aesthetic deficiencies of prior wood casket construction techniques when non-full length wood, whether either panels or boards, are used in the construction of wood caskets. Thus, manufacturing costs are reduced, but not with a consequent reduction in aesthetics or ornamentality of the caskets. In addition, tooling currently in use in the industry is able to be continued to be utilized.

The present invention is a casket comprising a casket shell including a floor, a pair of side walls and a pair of end walls. A lid is closable upon the shell. At least one of the walls is constructed of at least two panels having adjacent abutting edges forming a joint between the panels. A decorative feature disguises the joint to create the appearance of the two panels being a single panel. The decorative feature may either be formed in the two panels or placed over the two panels.

The one wall referred to above is preferably a side wall, having a longer dimension and a shorter dimension with the joint being transverse to the longer dimension. The joint joining the two panels is preferably a finger joint. The decorative feature preferably comprises at least one groove extending the visible length of the joint. More preferably, the one groove is formed partially in one of the two panels and partially in the other of the two panels. The decorative feature may further comprise a second groove formed in one of the two panels parallel to and coextensive with the one groove.

More preferably, the casket of the present invention comprises a casket shell including a floor, a pair of side walls and a pair of end walls, and further including a top mold around an upper portion of the walls and a base mold around a lower portion of the walls. A lid is closable upon the shell. Each side wall is constructed of at least two panels having adjacent abutting edges forming a joint between the panels, the joint being visible from a lowermost edge of the top mold to an uppermost edge of the base mold. A plurality of grooves are provided in the two panels extending from the lowermost edge of the top mold to an uppermost edge of the base mold disguising the joint to create the appearance of the two panels being a single panel.

The grooves are preferably spaced apart longitudinally and are V-shaped in cross section, and the joint preferably lies in the trough of one of the V-shaped grooves. Each side wall is preferably constructed of three panels, which are equal in length to each other and to the end walls. Thus, the walls of the casket shell may be fabricated of eight equal length or identical panels thereby simplifying construction.

Additional grooves may be provided in the side and end walls of the casket shell at the corners to match and compliment the grooves in the panels making up the side walls.

In another aspect of the present invention, a casket comprises a casket shell including a floor, a pair of side walls and a pair of end walls. A head end cap and a foot end cap, each closable upon the shell, each have a crown, a longer dimension and a shorter dimension. Each cap crown is constructed of a plurality of boards extending parallel to the longer dimension of the caps and includes a center spine board. Only the center spine board of both the crowns is fabricated from a single full length board which is sawed in two such that the grains of the head end and foot end spine boards match. The remaining ones of the plurality of cap crown boards are non-full length boards. The gap between the head and foot end caps, when closed upon the shell, in combination with the matching grain of the spine boards of the caps, helps to create the appearance of the cap crowns being fabricated of full length boards. In addition, while continuing to fabricate the head end and foot end caps utilizing at least one full length board, for example a full length center spine board, tooling currently in use for forming the caps is still usable.

A method of manufacturing a casket shell including a floor, a pair of side walls and a pair of end walls is also provided. The method comprises providing a pair of panels having respective end edges, abutting the respective end edges of the panels together forming a joint therebetween, disguising the joint with a decorative feature to create the appearance of the pair of panels being a single panel and forming at least a portion of one of the casket shell walls with the pair of panels. The step of disguising the joint preferably comprises forming a groove in the panels along the joint, and more preferably comprises the step of forming additional grooves in the panels near the joint.

A method of manufacturing head and foot end caps of a casket is also provided. The method comprises providing a center spine board having a length of the full length of the caps, providing a plurality of boards each having a length less than the full length of the caps, assembling a portion of the less than full length boards on either side of the center spine board, installing a pie on each end of the assembled boards, installing a rim around the periphery of the assembled boards and pies and sawing the assembled boards, pies and rim in two to create a head end cap and a foot end cap. The method may further comprise the step of installing a pair of header panels to the assembled boards, pies and rim prior to the step of sawing. The sawing step is performed between the header panels.

These and other advantages of the present invention will become more readily apparent during the following detailed description taken in conjunction with the drawings herein, in which:

DETAILED DESCRIPTION OF THE INVENTION

Figure 1:
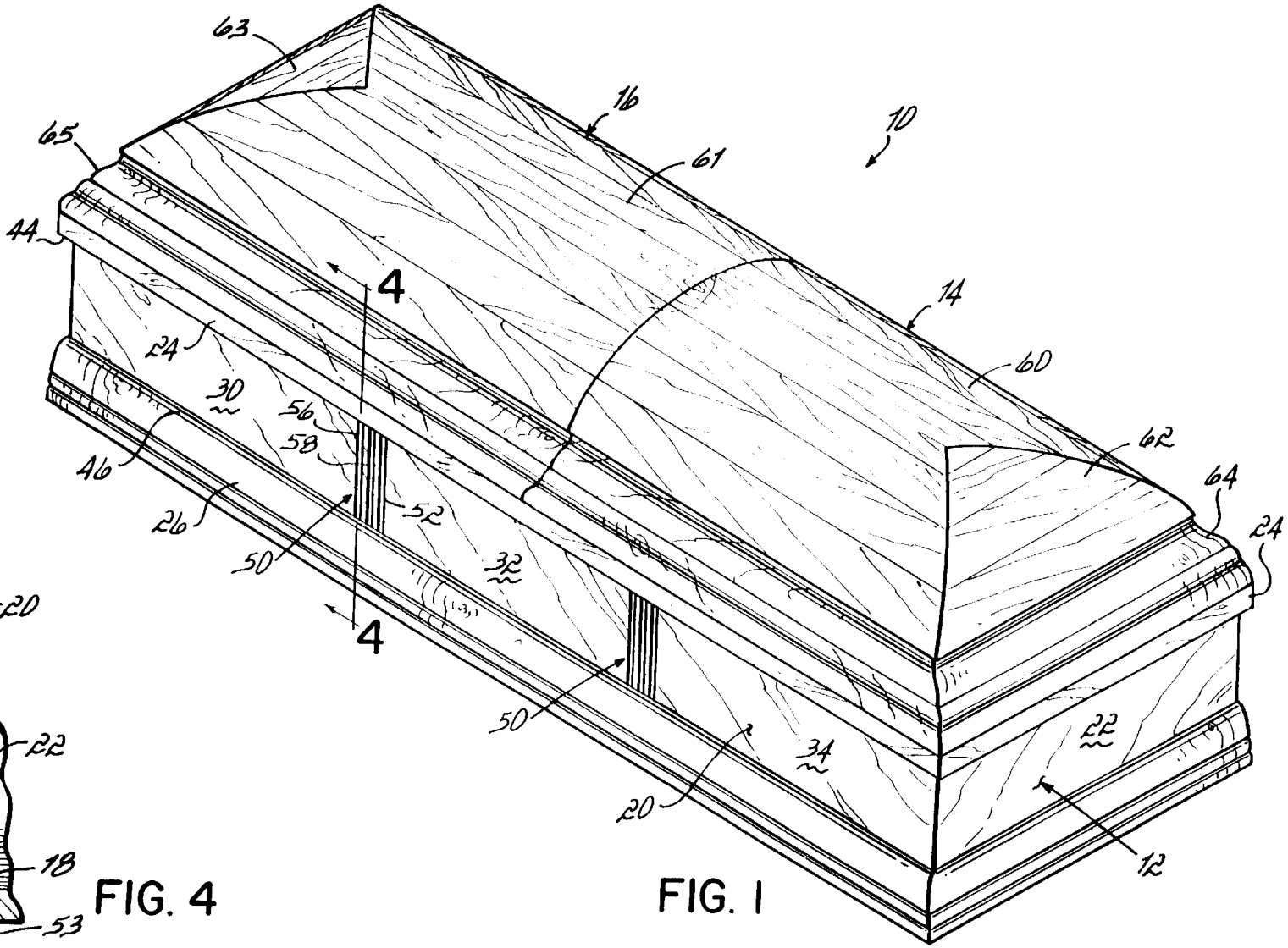
FIG. 1 is a perspective view of the casket of the present invention.

Referring first to FIG. 1, there is illustrated a wood casket 10 according to the present invention. The casket 10 comprises a casket shell 12, and head end 14 and foot end 16 caps closable upon the shell 12. Caps 14 and 16 may be pivoted to the shell 12 by hinges or the like as are known in the art.

The shell 12 includes a floor 18, a pair of side walls 20 and a pair of end walls 22. The shell 12 further includes a top mold 24 secured around an upper portion of the side walls 20 and end walls 22, and a base mold 26 secured around the lower portion of the side walls 20 and end walls 22.

Figure 4:
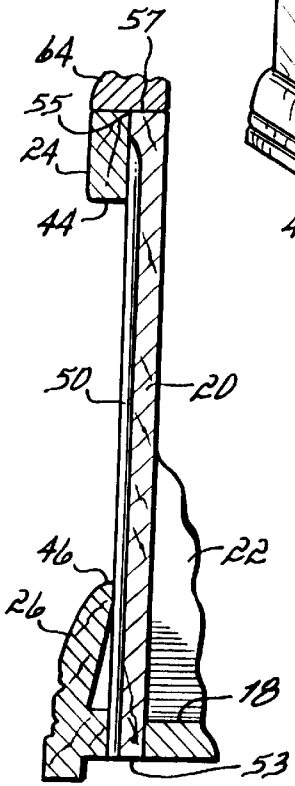
FIG. 4 is a view taken along line 4—4 of FIG. 1 illustrating the relationship of the decorative grooves to the casket shell side wall, top mold and base mold.
Figure 2:
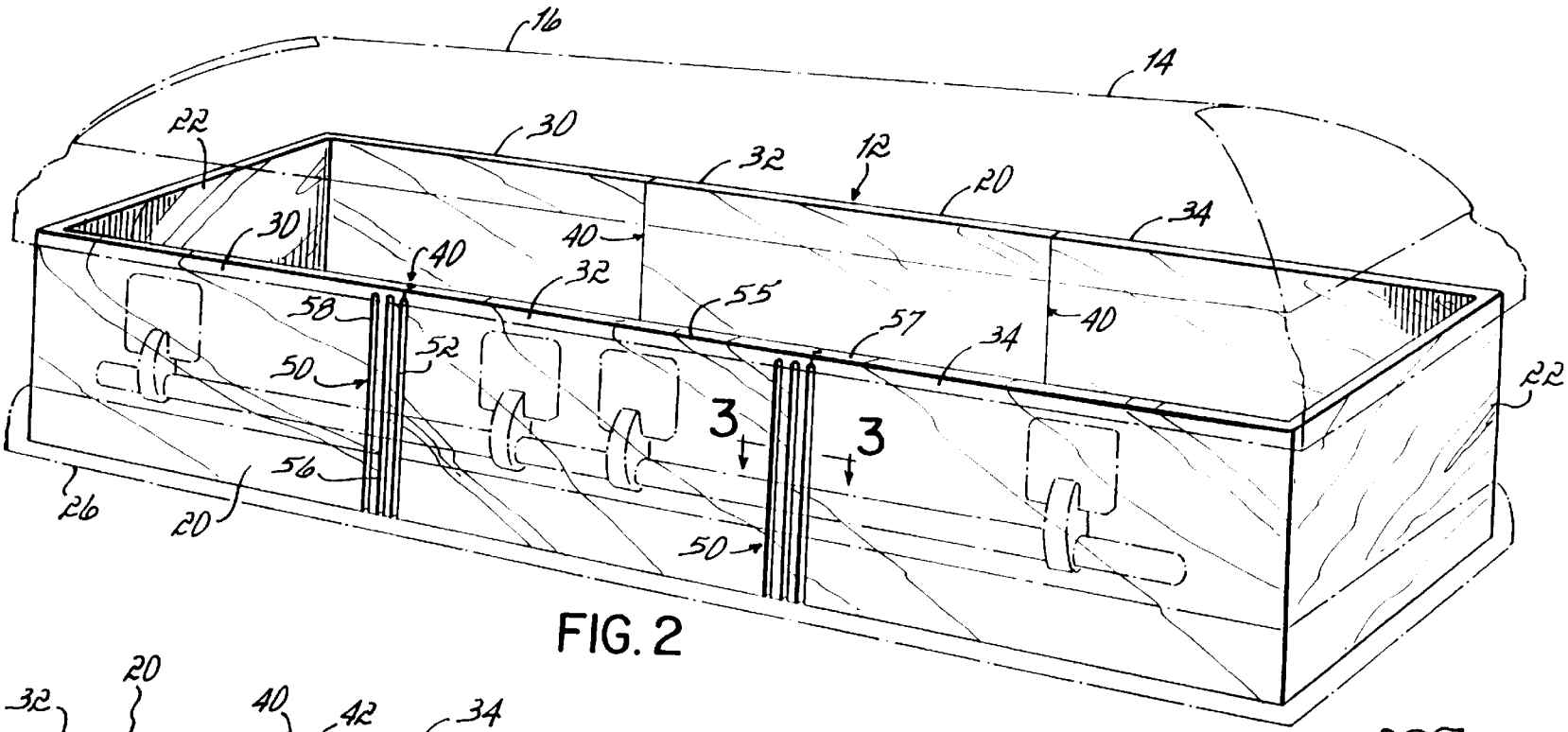
FIG. 2 is a view of just the casket shell side walls and end walls of FIG. 1, with the balance of the casket being shown in phantom.
Figure 3B:
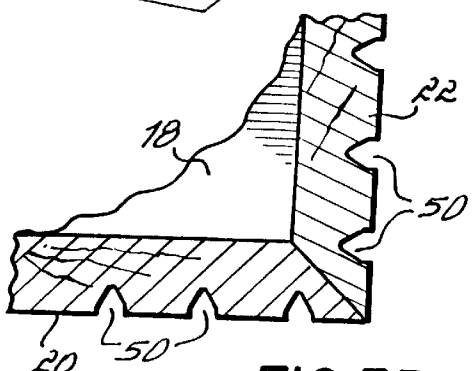
FIGS. 3A and 3B are cross-sectional views similar to that of FIG. 3 but of a corner of the casket shell and illustrating further decorative grooves in the casket shell.
Figure 3A:
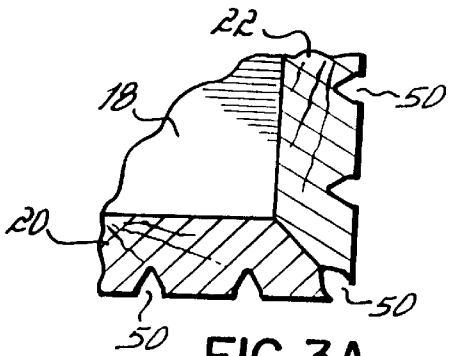
Figure 3:
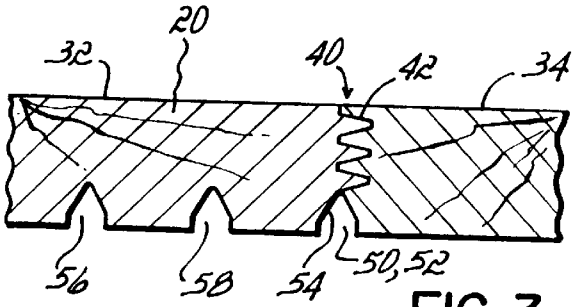
FIG. 3 is a view taken along line 3—3 of FIG. 2 illustrating the joint formed by two adjacent side wall panels and the decorative grooves disguising the same.

Referring now to FIGS. 2–4, it will be seen that shell side walls 20 are each formed of three separate panels of wood 30, 32 and 34. As shown in FIG. 3, the edges of abutting panels, for example those of panels 32 and 34, are joined via a finger joint 40 and suitable wood glue. A joint seam 42, transverse to the longitudinal dimension of the panels 32 and 34, results from the panels 32 and 34 being abutted together. Seam 42, along with the mismatch of the wood grain of the panels 32 and 34, would otherwise be visible from the lower edge 44 of the top mold 24 to the upper edge 46 of the base mold 26.

To obscure, camouflage or otherwise disguise the joint seam 42, along with the mismatch of the wood grains of the panels 32 and 34, a plurality of longitudinally spaced apart grooves 50, V-shaped in cross-section, are formed in the panels. In particular, one such V-shaped groove 52 is positioned so that the joint seam 42 is located at the base or within the trough 54 of the groove 52. One or more additional grooves 56 and 58 may be formed parallel to and adjacent to the first groove 52 in either or both of the panels 32 and 34. The effect of the grooves 50 is twofold. First, by positioning the seam 42 of the finger joint 40 in the trough 54 of one of the grooves 52, the seam 42 tends to go unnoticed. Second, by including one or more grooves 50 in the vicinity of the abutting edges of the panels 32 and 34, the focus of one's eyes is on the decorative grooves 50 themselves, rather than on the joint seam 42 or the mismatching wood grains of the panels 32 and 34. And, adding the grooves to the abutting edges of the panels helps to create the illusion of continuity of grain pattern of the wood panels. Thus, shorter pieces of wood panel, which would otherwise be discarded as scrap, are able to be utilized in the construction of the casket shell 12, thus reducing its cost of manufacture. However, the decorative grooves tend to disguise the fact that the shell side walls are "pieced together,"0 thus avoiding any negative connotations which might normally be associated with such a construction technique. In fact, an ordinary observer can be looking directly at the joint seam 42 and not even know it due to the optical illusion created by the grooves 50.

It is preferable to fabricate each side panel 20 out of three equal length panels, which themselves are equal in length to the wood panels forming the end walls 22. Thus, only a single length of wood panel need be made up for fabricating the casket 10; the entire casket shell 12 can then be fabricated from eight such panels along with a floor 18.

The end walls 22 and floor 18 are attached to the side walls 20 by a combination of glue and fasteners as is known in the art. Similarly, top mold 24 and base mold 26 are attached to the walls 20 and 22 by fasteners as is known in the art.

Referring to FIG. 4, it will be seen that once the panels are glued together to form the casket shell side walls, the grooves 50 may then be routed into the side walls 12. As shown in the Figure, while all the grooves 50 extend entirely to the bottom or lower edge 53 of the panels, the grooves 50 stop short of the upper edge 55 of the panel, thereby avoiding notching the upwardly facing edge 57 against which the caps 14 and 16 reside when in the closed position.

Additional grooves may be added to the shell side and end walls at the corners as illustrated in FIGS. 3A and 3B. By adding additional decorative grooves in the casket shell the grooves at abutting panel edges are somewhat "balanced out," and the tendency to focus on the joints of the abutting panels is reduced even further.

Referring now back to FIG. 1, head end cap 14 includes a crown portion 60, a pie portion 62 (the crown 60 and pie 62 sometimes referred to collectively as the "cover") and a rim portion 64. Similarly, foot end cap 16 includes a crown 61, a pie 63 and a rim 65. Though not shown in FIG. 1, head and foot end caps 14 and 16 also include a header panel located at their respective foot and head ends.

Figure 5:
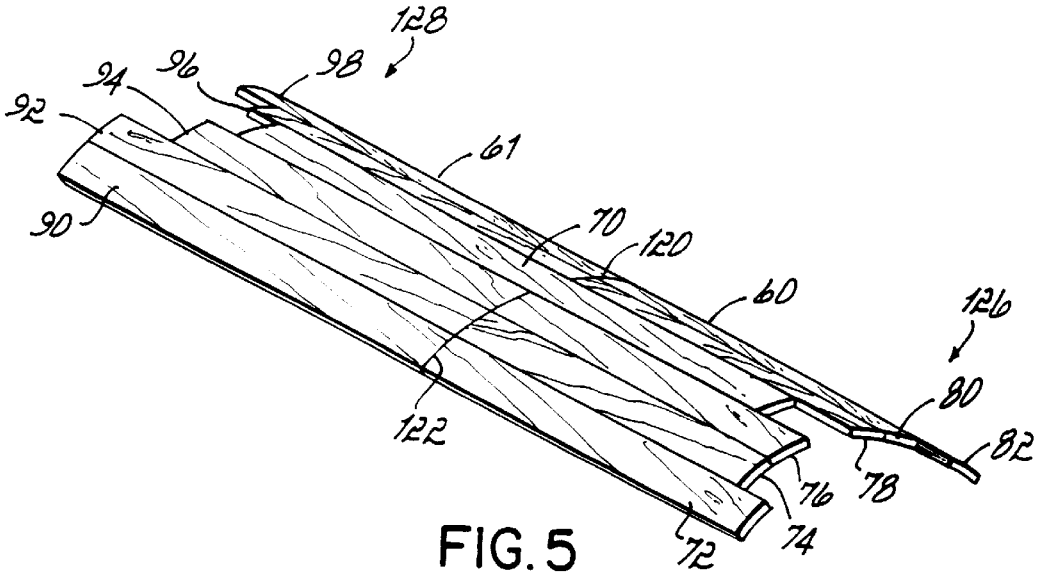
FIG. 5 is a view of the crowns of the head end and foot end caps, utilizing a full length center spine board with the balance of the boards being non-full length boards, after being removed from the tooling which forms the crown into a convex shape.

Referring now to FIG. 5, the crowns 60 and 61 are integrally fabricated of a plurality of boards, including a full length center spine board 70. The crown 60 of the head end cap 14 is fabricated of six separate boards 72, 74, 76, 78, 80 and 82, plus the head end portion of the full length center spine board 70. Similarly, the crown 61 of the foot end cap 16 is formed of six boards 90, 92, 94, 96, 98 and 100, plus the foot end portion of the full length center spine board 70. The foot ends of the non-full length boards making up the head end cap 14 abut the head ends of the non-full length boards making up the foot end cap 16 as at 120 and 122.

The assemblage of boards 70–100 with glue applied between them is fixtured into tooling to form the convex shape of the crowns 60 and 61. The tooling (not shown) is conventional in the art and may include a convex plate in the size and shape of the two crowns and against which the assemblage of boards 70–100 is pressed or formed by a plurality of pneumatic or hydraulic cylinders. An R-F glue curing apparatus may also be employed to aid curing of the glue gluing together the assemblage of boards 70–100.

Figure 6:
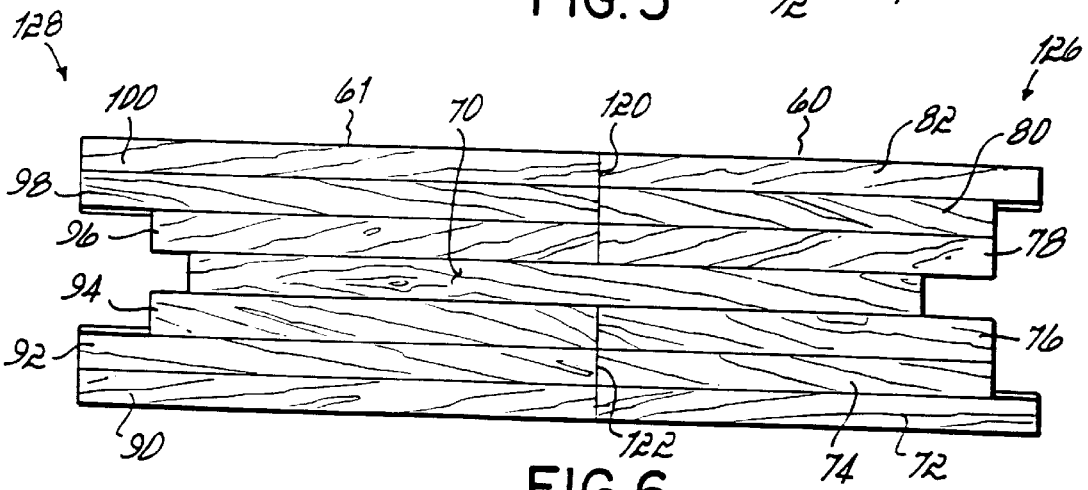
FIG. 6 is a top view of the crowns of FIG. 5.
Figure 7:
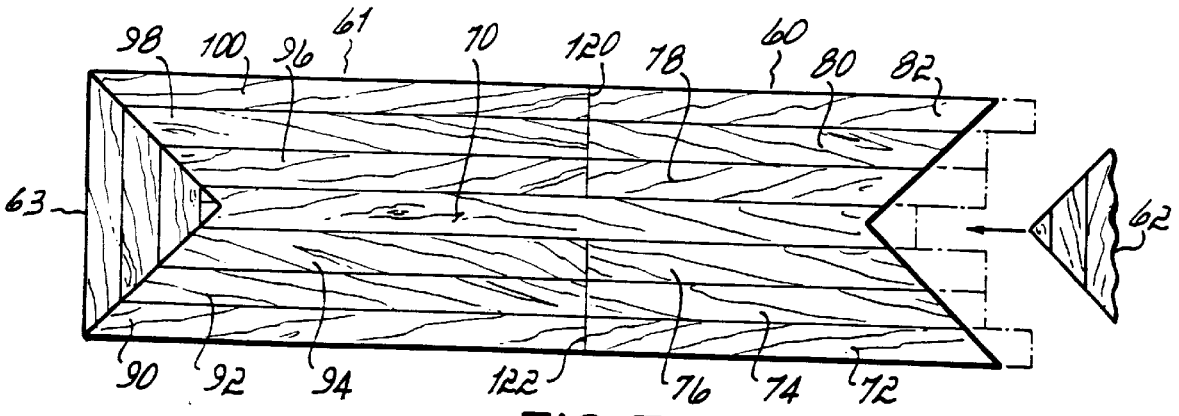
FIG. 7 is a view similar to FIG. 6 illustrating installation of the pie portions of the caps onto the crown portions.

Once the crown portions 60 and 61 of the caps 14 and 16 are removed from the tooling which forms the crowns 60 and 61 into their convex shape, the head and foot ends 126 and 128 of the crowns 60 and 61 respectively are sawed to accept the head end pie 62 and the foot end pie 63. The pies 62 and 63 are then installed with a combination of glue and fasteners as is known in the art. See FIGS. 6 and 7. Similar to the crown forming step, the step of sawing the ends of the crowns and installing the pies is performed after fixturing the crowns 60 and 61 into tooling (not shown but conventional in the art) adapted to receive the crowns 60 and 61 as a single or unitary assemblage.

Figure 8:
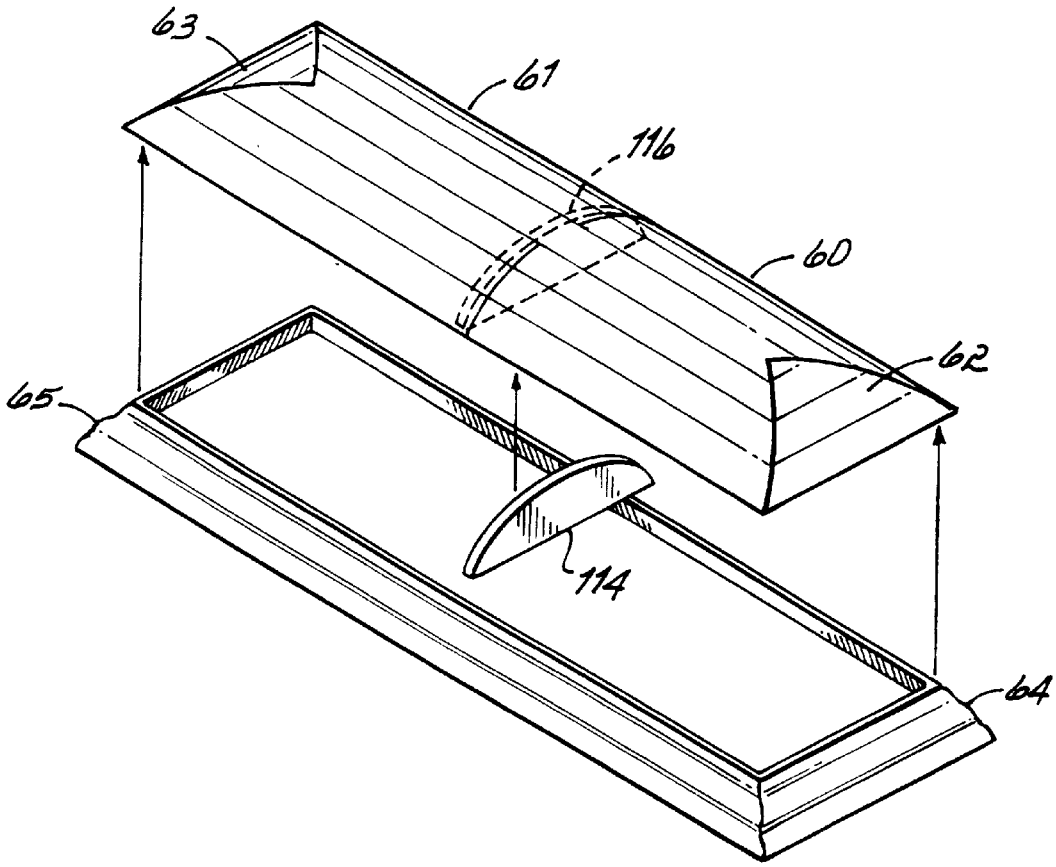
FIG. 8 is a perspective view of the assembled crowns and pies of FIG. 7 illustrating installation of the rim and header panels.

Next the header panels 114, 116 are installed into the crowns 60 and 61, still a single, unitary assemblage. See FIG. 8. The header panels 114, 116 are installed with a combination of glue and fasteners as is known in the art.

Finally, the rims 64 and 65 are installed around the crowns 60, 61 and pies 62 and 63 with glue and fasteners as is known in the art. Again, during this step the crowns are still a single, unitary assemblage fixtured into tooling (not shown) known in the art for this purpose.

Figure 9:
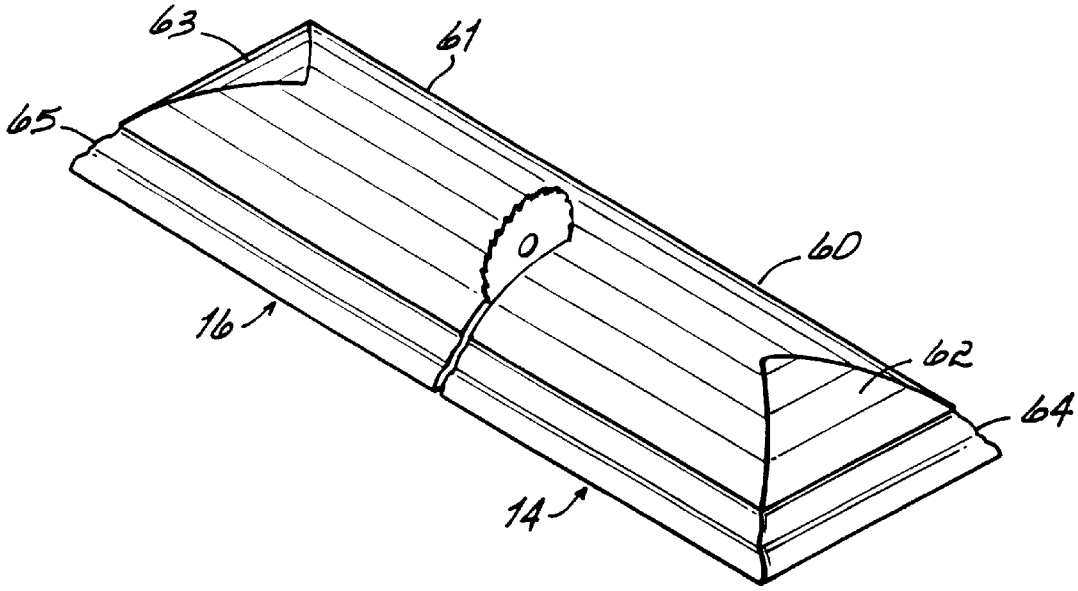
FIG. 9 is a view illustrating the crown and pie assembly of FIG. 7 with rim attached being sawed in two to make the separate head end and foot end caps.

The only remaining step is to saw the heretofore unitary, unseparated caps 14 and 16 in two as is diagrammatically shown in FIG. 9. The caps 14 and 16 may then be mounted to the shell 12 with fasteners as is known in the art.

One or more sanding steps may be performed on the caps during the above fabrication steps as desired or required.

During the above-described cap fabrication steps, it is important that the assembly of crowns 60, 61 and pies 62, 63 be an integral, unitary assemblage for at least two reasons. One is that because a number of the fabrication steps, for example, installation of the header panels, installation of the rim, installation of hardware such as latches and hinges and making the final saw cut, are all dimensioned from a common datum, for example one end of the crown and pie assembly or crown, pie and rim assembly. This would not be possible if the caps were fabricated separately. It is preferable to so dimension the caps for manufacture in order to avoid tolerance stackups and mismatches which would result from fabricating the caps separately, since the shell is likewise so dimensioned.

Another reason is that the tooling currently in use in the industry is set up for full length caps, i.e. a one-piece unitary cap as is used on a so-called full-couch casket. This allows either full length caps or separate head and foot end caps to be fabricated on a single set of tooling simply by including the last additional step of sawing the cap in two to form a so-called "split cap" having head and foot ends separately openable.

Accordingly, the above-described cap manufacturing technique allows the caps to be manufactured in a full length state, with only the final product being sawed in two, by utilizing the full-length center spine board; yet by reducing the number of full length boards employed in the caps to an absolute minimum the resulting cost of the caps is reduced. In addition, the combination of the gap between the head and foot end caps when closed upon the shell with the matching grain of the spine boards of the head and foot caps, tends to create the appearance of the cap crowns being constructed of full length boards, or at least to minimize the visual effect of the remaining ones of the cap crown boards being non-full length boards, i.e. to minimize the visual effect of the wood grains of respective ones of the head and foot end cap crown boards being non-matching.

By way of example, the cost savings on a $500 lumber package can be as much as $80 by employing the shell side wall and cap crown manufacturing techniques of this invention.

Those skilled in the art will readily recognize numerous adaptations and modifications which can be made to the present invention which will result in an improved casket, yet all of which will fall within the spirit and scope of the present invention as defined in the following claims. For example, while only the casket shell side walls have been illustrated as being fabricated from more than one panel, it is contemplated that the casket shell end walls could as well be fabricated of more than one panel. Further, while grooves have been disclosed as the preformed decorative feature disguising the joint between two adjacent panels, many other decorative features, both formed in the panels or overlying the panels, could be employed. That is to say, decorative features other than straight V-shaped grooves could be routed into the panels to disguise the joint; or a decorative trim piece, hardware or the like extending from the lower edge of the top mold to the upper edge of the base mold could be utilized to conceal the joint. Accordingly, the invention is to be limited only by the scope of the following claims and their equivalents.

What is claimed is:

1. A casket comprising:

a casket shell including a floor, a pair of side walls and a pair of end walls;

a lid having a longer dimension and a shorter dimension, said lid including a head end cap and a foot end cap each closable upon said shell, each said cap having a crown;

said lid being constructed of a plurality of boards having grains extending parallel to the longer dimension;

at least one, but substantially less than all, of said plurality of boards being a single full-length board sawed in two defining a joint therebetween such that the grains of said at least one, but substantially less than all, of said plurality of boards match at said joint thereby forming a continuous grain pattern thereat; and remaining ones of said plurality of boards being non-full length boards;

the gap between said head and foot end caps when closed upon said shell, in combination with the matching grain of said at least one, but substantially less than all, of said plurality of boards, creating the appearance of said cap crowns being constructed of full length boards.

2. A casket comprising:

a casket shell including a floor, a pair of side walls and a pair of end walls;

a lid having a longer dimension and a shorter dimension, said lid including a head end cap and a foot end cap each closable upon said shell, each said cap having a crown;

said lid being constructed of a plurality of boards having grains extending parallel to the longer dimension;

at least one, but substantially less than all, of said plurality of boards being a single full-length board sawed in two defining a joint therebetween such that the grains of said at least one, but substantially less than all, of said plurality of boards match at said joint thereby forming a continuous grain pattern thereat; and remaining ones of said plurality of boards being non-full length boards;

the gap between said head and foot end caps when closed upon said shell, in combination with the matching grain of said at least one, but substantially less than all, of said plurality of boards, creating the appearance of said cap crowns being constructed of full length boards;

at least one of said walls constructed of at least two panels having adjacent abutting edges forming a joint between said panels; and a decorative feature disguising said joint to create the appearance of said at least two panels being a single panel.

* * * * *